US009015968B2

(12) United States Patent
Kovar et al.

(10) Patent No.: US 9,015,968 B2
(45) Date of Patent: Apr. 28, 2015

(54) THUMB FOR AN EXCAVATOR MACHINE WITH STRUCTURE SUPPORT

(75) Inventors: Aaron Dean Kovar, Topeka, KS (US); Don Harlen Kleiner, Belvue, KS (US); Ryan Patrick Shea, Manhattan, KS (US)

(73) Assignee: Caterpillar Inc., Peoria, IL (US)

( * ) Notice: Subject to any disclaimer, the term of this patent is extended or adjusted under 35 U.S.C. 154(b) by 376 days.

(21) Appl. No.: 13/543,504

(22) Filed: Jul. 6, 2012

(65) Prior Publication Data

US 2014/0007467 A1 Jan. 9, 2014

(51) Int. Cl.
*E02F 3/413* (2006.01)
*E02F 3/40* (2006.01)

(52) U.S. Cl.
CPC ..... *E02F 3/404* (2013.01)

(58) Field of Classification Search
USPC ..... 37/406; 414/723
See application file for complete search history.

(56) References Cited

U.S. PATENT DOCUMENTS

| | | | | |
|---|---|---|---|---|
| 5,553,408 | A | 9/1996 | Townsend | |
| 5,813,822 | A | 9/1998 | Pisco | |
| 6,450,081 | B1 | 9/2002 | Sorbel | |
| 7,165,930 | B2 | 1/2007 | Pisco | |
| 7,383,681 | B2 | 6/2008 | Connolly et al. | |
| 7,533,481 | B2 | 5/2009 | McCoy | |
| 7,617,619 | B2 * | 11/2009 | Cox | 37/406 |
| 7,818,901 | B2 | 10/2010 | Zeno et al. | |
| 8,695,239 | B2 * | 4/2014 | Seda et al. | 37/406 |
| 8,827,626 | B2 * | 9/2014 | Seljestad | 414/724 |
| 2010/0058622 | A1 * | 3/2010 | Calvert et al. | 37/405 |

OTHER PUBLICATIONS

ACS. Industries, Inc., Weld-On Hydraulic Thumb, website pages, http://www.acs-coupler.com/excavator/weld_on_thumb_hydraulic (3 pages), Mar. 19, 2012.
http://www.acs-coupler.com/imq/ex_thm_weldOn_hyd.lg.ipg (1 page), Mar. 19, 2012.
Carter, Machinery, Excavator Thumb, photograph (1 page), Mar. 2010.
Caterpillar, Inc., Hydraulic Excavator Rake, part No. 313-6325, rendering (1 page), undated.
Caterpillar, Inc., Stiff-Link Excavator Thumb, part No. 305-4559, rendering (1 page), May 2006.
Empire Bucket, Inc. Excavator Thumb, photographs (1 page), Feb. 2010.

(Continued)

*Primary Examiner* — Gary Hartmann
(74) *Attorney, Agent, or Firm* — Miller, Matthias & Hull LLP

(57) ABSTRACT

A counteracting thumb for an implement of a machine may include first and second structure support plates each having first and second planar portions connected by an intermediate curved portion to orient the planar portions at an obtuse angle relative to each other. A first end edge of the first plate may be connected to an inner surface of the second plate proximate a first end edge of the second plate, and second end edge of the second plate may be connected to an inner surface of the first plate proximate a second end edge of the first plate. Side plates of the thumb may be connected to an outer surface of the first plate, and teeth of the thumb may be connected to an outer surface of the second plate.

20 Claims, 4 Drawing Sheets

(56) References Cited

OTHER PUBLICATIONS

Geith International, Ltd., Geith Thumb Range, Gallery, (1 page), Mar. 19, 2012. http://www.geith.com/product_detail.aspx?pageid=0f3f0043-83f7-4102-bbd7-2073f99cd786.
Geith International, Ltd., Geith Thumb Range, website pages, http://www.geith.com/geiththumb.aspx (1 page), Mar. 19, 2012.
Gentec Equipment, website pages, http://www.gentecequipment.com/ (2 pages), Mar. 19, 2012.
Gentec Equipment, website page, http://www.gentecequipment.com/imaqes/products/thumbs/ht-2456-3260.ipq (1 page), Mar. 19, 2012.
H.O. Penn Machinery Co., Inc., Excavator Thumb, photograph (1 page), Mar. 2010.
NC Machinery Co., Excavator Thumb, photograph (1 page), Mar. 2010.
Solebee's Equipment & Attachments, LLC, Excavator Thumbs, website page, http://www.solesbeesequipment.com/excavator_thumbs.php (1 page), Mar. 19, 2012.
Wagner Equipment Excavator Thumb, photographs (1 page), Feb. 2010.
Western States Equipment, Excavator Thumb, photograph (1 page), Mar. 2010.

* cited by examiner

THUMB FOR AN EXCAVATOR MACHINE WITH STRUCTURE SUPPORT

TECHNICAL FIELD

This disclosure relates generally to excavator machines having articulating ground-engaging implements and counteracting thumbs and, in particular, to structure support in the counteracting thumb for withstanding forces and stresses in the thumb during operation of the excavator machine to operate on work material.

BACKGROUND

Mining and construction machines such as backhoe loaders and excavators employ various implements, such as buckets, rams, forks, grapples, thumbs, and the like, to perform different operations. For example, a machine may use a bucket and counteracting thumb to grasp, hold, and lift odd-shaped work material such as boulders, pipes, trees, structural components, and the like. These types of work material loads cause uneven weight distributions across the bucket and thumb and concentrated stresses on the components. A strong structure support that connects teeth of the thumb to the side plates and main body of the thumb may provide for more load transfer from one side of the thumb to the other. However, currently known structure supports for counteracting thumbs have structural and other limitations affecting their adaptation for various work environments in which the excavator machines may operate.

Some current thumb designs incorporate structure support that does not effectively transfer offset loads between the side plates of the thumb. For example, U.S. Pat. No. 5,813,822 to Pisco discloses a bucket and thumb combination for attachment to an excavator arm in which both the bucket and the thumb share a common axis of rotation relative to one another and relative to the excavator arm and are independently movable. The side plates and teeth of the thumb are connected by a structure support in the form of a flat plate. The flat plate is cheaper and easier to source worldwide than other types of structure supports such as circular and square tubes discussed below that can be dimensionally dependent on the region of sourcing. However, the flat connecting plate is not effective in transferring torque loads from the side plate with high concentration of loading to the side plate on the opposite side of the thumb. As a result, high stress concentrations occur on the loaded side of the thumb, thereby requiring thicker side plates on each side that add weight and cost to the thumb design.

Other thumb designs provide additional structure support but have other limitations that can compromise the design and integrity of the thumb. For example, U.S. Pat. No. 7,818,901 to Zeno et al. discloses a dipper stick, tool and thumb combination including a progressive linkage for connecting the thumb to a thumb actuator. The thumb disclosed in the Zeno et al. patent includes a circular tube as the structure support connecting the teeth of the thumb to the side plates. The tube may provide better load transfer between the side plates under offset load conditions than a flat plate, but the circular outer surface to which the side plates and the teeth are attached can present issues in supporting torsion loads that are created about the longitudinal axis of the circular tube. Torsion loads can occur when the bucket and thumb clamp down around work material with the teeth of the thumb engaging the work material. Due to the round surface of the tube, the amount of weld length between the circular tube and the side plates and teeth may not be sufficient given the space constraints of the design, and the torsion loads and resulting stresses may be concentrated at the welds connecting the teeth to the circular tube, and the circular tube to the side plates, making failures in the welds problematic.

Square tubes have been used in thumbs as an alternative to the circular tubes shown in the Zeno et al. patent. The square tubes may provide comparable load transfer between the side plates as the circular tubes, but create additional issues in designing and assembling the thumb. For example, in many implementations, the side plates and the teeth may mount on shared sides of the square tube causing an overlap in the structures. With the side plates infringing on the space for the teeth, interference with the side plates may inhibit the ability to place the teeth in the optimal locations along the tube. The square tube may also encroach the space within the thumb and interfere with the movement of the linkages that open and close the thumb.

For these reasons, a need exists for an improved structure support in a counteracting thumb of an excavation machine that assists in distributing unbalanced loads between the side plates of the thumb and bearing the loads and stresses on the teeth and side plates of the thumb without interfering with the free movement of the linkages controlling the location of the thumb.

SUMMARY OF THE DISCLOSURE

In one aspect of the present disclosure, a thumb for a machine is disclosed. The thumb may include a first side plate having an outer surface, an inner surface oppositely disposed from the outer surface, a first end having a connection for pivotally connecting the first side plate to a linkage assembly of the machine, and a second end oppositely disposed from the first end, a second side plate having an outer surface, an inner surface oppositely disposed from the outer surface, a first end having a connection for pivotally connecting the first side plate to a linkage assembly of the machine, and a second end oppositely disposed from the first end, and a plurality of teeth each having a work material engaging end and a structure support end oppositely disposed from the work material engaging end. The thumb may also include a thumb structure support having a first structure support plate having oppositely disposed first and second end edges, oppositely disposed first and second lateral edges, an outer surface having a convex curvature as the outer surface extends from the first end edge to the second end edge, and an inner surface opposite the outer surface, the second end of the first side plate being connected to the outer surface of the first structure support plate proximate the first lateral edge of the first structure support plate, the second end of the second side plate being connected to the outer surface of the first structure support plate proximate the second lateral edge, and a second structure support plate having oppositely disposed first and second end edges, oppositely disposed first and second lateral edges, an outer surface having a convex curvature as the outer surface extends from the first end edge to the second end edge, and an inner surface opposite the outer surface. The first end edge of the first structure support plate may be connected to the second structure support plate proximate the first end edge of the second structure support plate, the second end edge of the second structure support plate may be connected to the first structure support plate proximate the second end edge of the first structure support plate, and the structure support end of each of the plurality of teeth may be connected to the outer surface of the second structure support plate In another aspect of the present disclosure, a thumb structure support is disclosed for connecting first and second side plates of a thumb of a machine to a plurality of teeth of the thumb. The thumb structure support may include a first structure support plate having oppositely disposed first and second end edges, oppositely disposed first and second lateral edges, an outer surface having a convex curvature as the outer surface extends from the first end edge to the second end edge, and an inner surface opposite the outer surface, the outer surface of the first structure support plate having the first side plate and the second side plate of the thumb connected thereto proximate the first lateral edge and the second lateral edge, respectively. The thumb structure support may further include a second structure support plate having oppositely disposed first and second end edges, oppositely disposed first and second lateral edges, an outer surface having a convex curvature as the outer surface extends from the first end edge to the second end edge, and an inner surface opposite the outer surface. The first end edge of the first structure support plate may be connected to the second structure support plate proximate the first end edge of the second structure support plate, the second end edge of the second structure support plate may be connected to the first structure support plate proximate the second end edge of the first structure support plate, and the outer surface of the second structure support plate may have the plurality of teeth of the thumb connected thereto.

In a further aspect of the present disclosure, a thumb for a machine is disclosed. The thumb may include a thumb structure support having a first structure support plate having oppositely disposed first and second end edges, oppositely disposed first and second lateral edges, a first planar portion extending inwardly from the first end edge and a second planar portion extending inwardly from the second end edge, the first planar portion and the second planar portion being oriented with respect to each other at an obtuse angle, an outer surface and an inner surface opposite the outer surface. The thumb structure support may also include a second structure support plate having oppositely disposed first and second end edges, oppositely disposed first and second lateral edges, a first planar portion extending inwardly from the first end edge and a second planar portion extending inwardly from the second end edge, the first planar portion and the second planar portion being oriented with respect to each other at an obtuse angle, an outer surface and an inner surface opposite the outer surface. The first end edge of the first structure support plate may be connected to the second structure support plate proximate the first end edge of the second structure support plate, and the second end edge of the second structure support plate may be connected to the first structure support plate proximate the second end edge of the first structure support plate. The thumb may also include a first side plate having an outer surface, an inner surface oppositely disposed from the outer surface, a first end having a connection for pivotally connecting the first side plate to a linkage assembly of the machine, and a second end oppositely disposed from the first end, the second end of the first side plate having a shape corresponding to a shape of the outer surface of the first structure support plate and being connected to the outer surface of the first structure support plate proximate the first lateral edge of the first structure support plate, and a second side plate having an outer surface, an inner surface oppositely disposed from the outer surface, a first end having a connection for pivotally connecting the first side plate to a linkage assembly of the machine, and a second end oppositely disposed from the first end, the second end of the second side plate having a shape corresponding to a shape of the outer surface of the first structure support plate and being connected to the outer surface of the first structure support plate. Still further, the thumb may include a plurality of teeth each having a work material engaging end and a structure support end oppositely disposed from the work material engaging end, the structure support end having a shape corresponding to a shape of the outer surface of the second structure support plate and being connected to the outer surface of the second structure support plate In a still further aspect of the present disclosure, a support structure for connecting two components together is disclosed. The support structure may include a first plate having oppositely disposed first and second end edges, an outer surface having a convex curvature as the outer surface extends from the first end edge to the second end edge, and an inner surface opposite the outer surface, and a second plate having oppositely disposed first and second end edges, an outer surface having a convex curvature as the outer surface extends from the first end edge to the second end edge, and an inner surface opposite the outer surface. The first and second plates may be connected and overlap at opposite ends so that the first end edge of the second plate extends beyond the first end edge of the first plate and the second end edge of the first plate extends beyond the second end edge of the second plate.

Additional aspects are defined by the claims of this patent.

DETAILED DESCRIPTION

Although the following text sets forth a detailed description of numerous different embodiments of the, it should be understood that the legal scope of protection is defined by the words of the claims set forth at the end of this patent. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims defining the scope of protection.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

Figure 1:
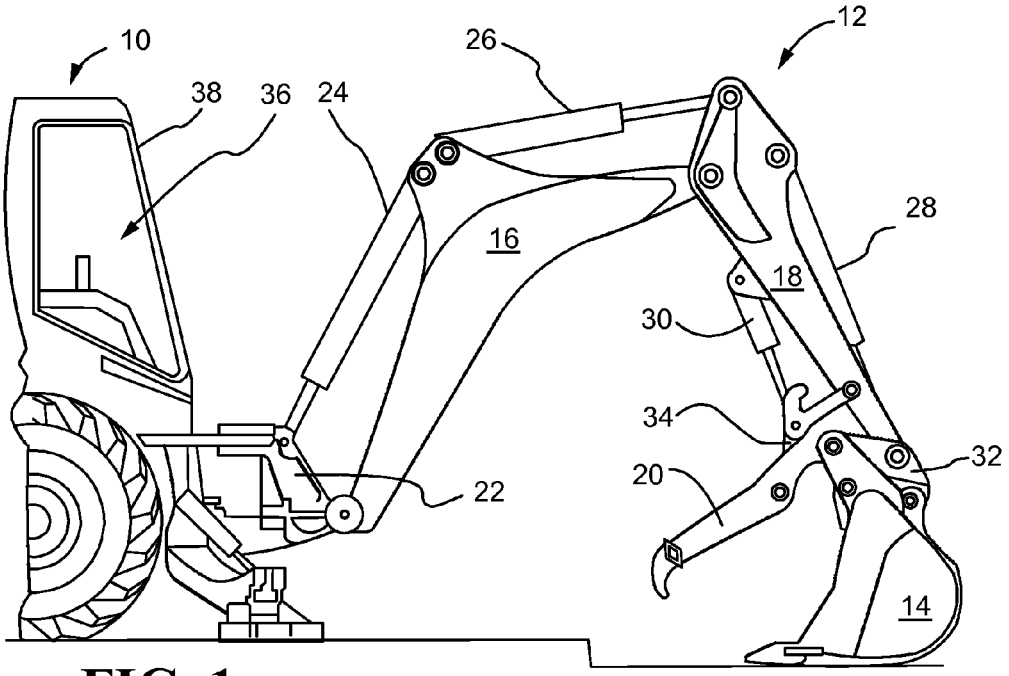
FIG. 1 is a side elevation view of a machine having an articulating ground-engaging implement counteracting thumb in accordance with the present disclosure.

FIG. 1 depicts a machine 10 to perform different operations on work material at a work site. The machine 10 may include a linkage assembly 12 for manipulating an implement, such as bucket 14, to perform the operations on the work material. The machine 10 is depicted as a backhoe loader, but may also be an excavator or any other type of machine having a linkage for performing operations on work material. As shown, the linkage assembly 12 includes a boom 16, a stick 18 pivotally coupled to the boom 16, the bucket 14 pivotally coupled to the stick 18, and a counteracting thumb 20 in accordance with the present disclosure also pivotally coupled to the stick 18. The linkage assembly 12 is shown pivotally connected to a boom support bracket 22 of the machine 10. A boom lift actuator 24 is operably coupled to the boom 16 and the machine 10 and rotates the boom 16 with respect to the machine 10 to raise and lower the linkage assembly 12. Similarly, a stick extension actuator 26 is operably coupled to the boom 16 and the stick 18 and rotates the stick 18 with respect to the boom 16. A bucket articulation actuator 28 and a thumb actuator 30 are operably coupled to the stick 18 and the bucket 14 and the thumb 20, respectively, by linkages 32, 34, respectively, and rotate the bucket 14 and the thumb 20 with respect to the stick 18. The actuators 24, 26, 28, 30 may be hydraulic cylinders each having a head end and a rod end. Directing hydraulic fluid to the head ends may extend the actuators 24, 26, 28, 30, while directing fluid to the rod ends may retract the actuators 24, 26, 28, 30. An operator may use a plurality of levers 36 within an operator cab 38 of the machine 10 to command the actuators 24, 26, 28, 30 through a control device (not shown).

During operation of the machine 10, the bucket 14 and thumb 20 in combination may be used to pick up odd-sized loads of work material. For example, the operator of the machine 10 may pick up a boulder by scooping the boulder into the bucket 14 and the actuating the thumb actuator 30 to close the thumb 20 down over the bucket 14 and engage the boulder to hold the boulder therein until the boulder is dumped. Elongated work material, such as tree trunks and piping may be picked up by surrounding the material with the bucket 14 and thumb 20, close the bucket 14 and thumb 20 down on the work material and lift the material off the ground. Manipulating these types of materials can cause unbalanced loads of the bucket 14 and thumb 20 such that more weight is loaded on one side of the bucket 14 and thumb 20.

Figure 2:
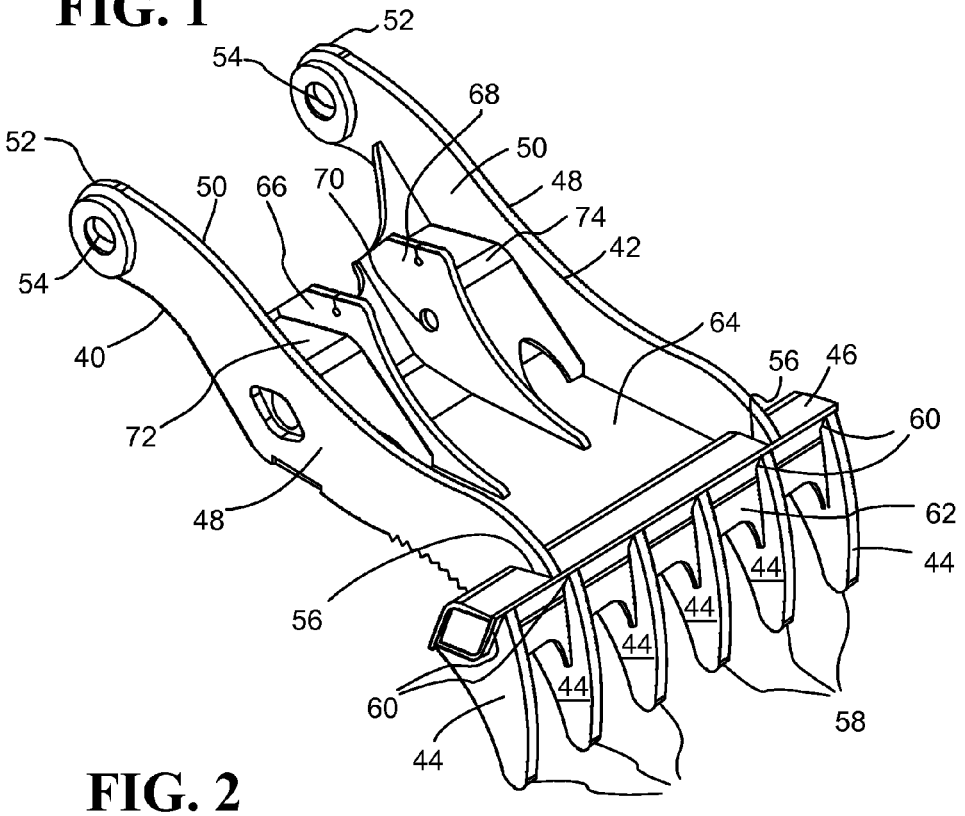
FIG. 2 is a front right perspective view of the counteracting thumb of the machine of FIG. 1.

FIG. 2 illustrates the counteracting thumb 20 in accordance with the present disclosure that is configured to distribute such unbalanced loads across the thumb 20. The thumb 20 may include a first side plate 40 and a second side plate 42, and a plurality of teeth 44 connected to the side plates 40, 42 by a support structure such as a thumb structure support 46 in accordance with the present disclosure. Each of the side plates 40, 42 may include an outer surface 48, an inner surface 50 facing the inner surface 50 of the other side plate 40, 42, a first pivot end 52 having a reinforced opening 54 for pivotally connecting the side plates 40, 42 to the stick 18 via a pin (not shown) that may be shared with the bucket 14 or may be shared with a coupler (not shown) connecting the bucket 14 to the stick 18. The side plates 40, 42 may further include second ends 56 opposite the first pivot ends 52 that may be connected to the thumb structure support 46 as discussed further below.

The plurality of teeth 44 may each have a first work material engaging end 58 and an oppositely disposed second structure support end 60 connected to the thumb structure support 46. The teeth 44 may be evenly spaced across the width of the thumb structure support 46, or may be unevenly placed at appropriate locations for engaging the work material. A gusset plate 62 may be provided to unitize the teeth 44 and to provide additional strength to withstand lateral loads on the teeth 44 acting generally parallel to the axis defined by the openings 54. The thumb 20 may have a separate gusset plate 62 between each pair of teeth 44, or may have a single gusset plate 62 extending across the width of the thumb structure support 46 and interconnecting all of the teeth 44 as illustrated and described more fully below. The thumb 20 may further include a bottom support plate 64 having oppositely disposed first and second end edges and oppositely disposed first and second lateral edges. The first lateral edge of the bottom support plate 64 may connected to the inner surface 50 of the first side plate 40, and the second lateral edge of the bottom support plate 64 may be connected to the inner surface 50 of the second side plate 42. The first end edge of the bottom support plate 64 may be connected to the thumb structure support 46 between the side plates 40, 42 and opposite the teeth 44.

The bottom support plate 64 may provide an attachment platform for components to which the linkage 34 may be attached. The attachment platform may include a pair of spaced yoke plates 66, 68 having openings 70 through which a pivot pin (not shown) may extend to pivotally connect the linkage 34 to the thumb 20 between the yoke plates 66, 68. The yoke plates 66, 68 may be further reinforced by yoke support plates 72, 74 having oppositely disposed lateral edges connected to the inner surface 50 of the corresponding side plate 40, 42 and the outer surface of the corresponding yoke plate 66, 68. The bottom support plate 64 and the yoke support plates 72, 74 may have complimentary bends therein so that oppositely disposed front and rear end edges of the yoke support plates 72, 74 may be connected to a top surface of the bottom support plate 64.

Figure 3:
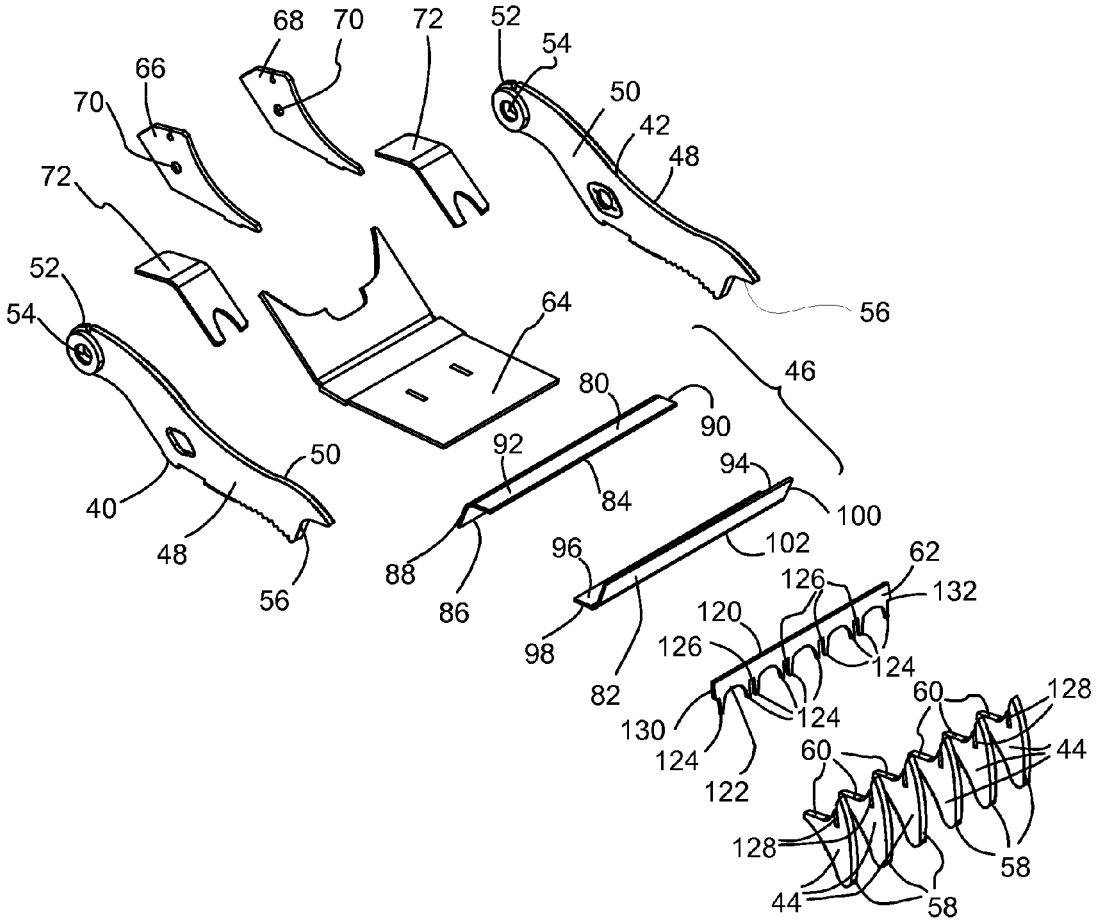
FIG. 3 is an exploded view of the counteracting thumb the machine of FIG. 1.

In the exploded view of FIG. 3, the thumb structure support 46 may have a two-piece construction. The thumb structure support 46 may include a first structure support plate 80 and a second structure support plate 82. The first structure support plate 80 may include oppositely disposed first and second end edges 84, 86 and oppositely disposed first and second lateral edges 88, 90. The first structure support plate 80 may be bent so that an outer surface 92 of the first structure support plate 80 may have a generally convex shape as the first structure support plate 80 extends from the first end edge 84 toward the second end edge 86. The second structure support plate 82 may have a generally similar and complimentary configuration to the first structure support plate 80, with first and second end edges 94, 96, first and second lateral edges 98, 100, and a generally convex outer surface 102, and the structure support plates 80, 82 may have identical configurations as discussed more fully hereinafter.

Figure 4:
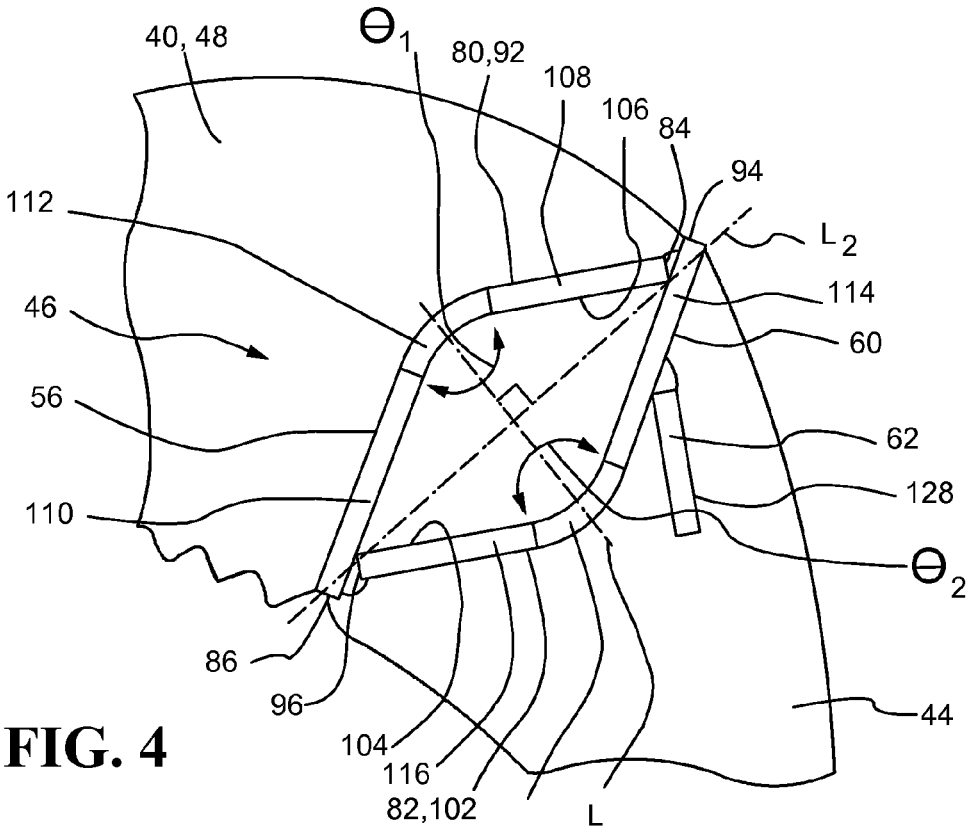
FIG. 4 is a side view of a portion of the counteracting thumb of FIG. 2.

As shown in the enlarged view of FIG. 4, the thumb structure support 46 may be constructed with the opposite end edge pairs 84/94, 86/96 of the plates 80, 82 overlapping in an alternated arrangement such that the first end edge 94 of the second structure support plate 82 extends beyond the first end edge 84 of the first structure support plate 80 and the second end edge 86 of the second structure support plate 80 extends beyond the second end edge 96 of the second structure support plate 82. The first end edge 84 of the first structure support plate 80 connected to the second structure support plate 82 proximate the first end edge 94 and the second end edge 96 of the second structure support plate 82 connected to the first structure support plate 80 proximate the second end edge 84. In this particular embodiment, the first end edge 86 is connected by a weld to an inner surface of the second structure support plate 82, and the second end edge 96 is connected by a weld to an inner surface of the first structure support plate 80. In one alternate arrangement, the first end edge 94 may abut the inner surface 106 and the second end edge 86 may abut the inner surface 104. Inner surfaces 104, 106 may have generally concave shapes that are complimentary to the shapes of the outer surfaces 102, 92, respectively, so that the structure support plates 80, 82 have generally uniform thicknesses.

The first structure support plate 80 may include a first planar portion 108 extending inwardly from the first end edge 84, and second planar portion 110 extending inwardly from the second end edge 86, and an intermediate curved portion 112 between the planar portions 108, 110 orienting the planar portions 108, 110 at an obtuse angle $\theta_1$. Similarly, the second structure support plate 82 may include a first planar portion 114 extending inwardly from the first end edge 94, and second planar portion 116 extending inwardly from the second end edge 96, and an intermediate curved portion 118 between the planar portions 114, 116 orienting the planar portions 114, 116 at a second obtuse angle $\theta_2$. In various embodiments, the obtuse angles $\theta_1$, $\theta_2$ may be equal, and may be equal to approximately 120° to provide sufficient structural support to transmit offset loads between the side plates 40, 42.

The first end edge 84 may be disposed more inwardly into the thumb structure support 46 than the first end edge 94. In this configuration, the teeth 44 may only contact the first planar portion 114 of the structure support plate 82 proximate the first end edge 94, and no part of the structure support plate 80 proximate the first end edge 84 contacts the teeth 44. With this configuration, as the teeth 44 are loaded during operation and tend to rotate backward, the teeth 44 are in full contact with the structure support plate 82, and rotation of the structure support plate 82 is resisted by the structure support plate 80 and side plates 40, 42. To achieve this configuration, the first planar portion 108 may be relatively shorter than the second planar portion 110, and the second planar portion 116 may be relatively shorter than the first planar portion 114. The shorter first planar portion 108 is adjacent to the longer first planar portion 114, and similarly the shorter second planar portion 116 is adjacent to the longer second planar portion 110. The second end edge 96 contacts the inner surface 106 in a similar manner as the first end edge 84 contacts the inner surface 104. Dimensioned in this way, a first line $L_1$ connecting the centers of the radiuses of the intermediate curved portions 112, 118 may be approximately perpendicular to a second line $L_2$ drawn through the points of contact between the inner surfaces 104, 106.

Returning to FIG. 3, the configuration of one embodiment of the gusset plate 62 is more clearly illustrated. The gusset plate 62 may have a first end edge 120 that may be connected to the outer surface 102 of the second structure support plate 82 and extend outwardly from the first planar portion 114. A second end edge 122 of the gusset plate 62 may have a plurality of tines 124 extending there from with pairs of the tines 124 forming slots 126 for locating the teeth 44 along the outer surface 102 the second structure support plate 82. The teeth 44 may each have a notch 128 extending inwardly from the structure support end 60 and having a depth approximately equal to the distance between the first end edge 120 and the second end edge 122 of the gusset plate 62. After the gusset plate 62 is connected to the outer surface 102 of the second structure support plate 82, each of the teeth 44 may be inserted between a pair of tines 124 in one of the slots 126 with the gusset plate 62 being received into the notch 128 of the tooth 44 and the structure support end 60 engaging and being connected to the outer surface 102. Lateral edges 130, 132 may each have a single tine 124 against which the end teeth 44 may abut for positing the teeth 44 on the second structure support plate 82.

INDUSTRIAL APPLICABILITY

The counteracting thumb 20 having the thumb structure support 46 in accordance with the present disclosure provides effective load transfer of offset loads between the side plates 40, 42, improved resistance to torsion loads on the teeth 44 and side plates 40, 42, and efficient packaging of the structure support 46 for storage and assembly of the thumb 20. The configuration of the structure support plates 80, 82 allows the thumb structure support 46 provide structural and design improvements over previously know flat plate support structures such as that shown in the Pisco patent discussed above. The increased depth of the thumb structure support 46 connecting the teeth 44 to the side plates 40, 42 and the bottom support plate 64 of the thumb 20 allows for more load transfer from one side plate 40, 42 of the thumb 20 to the other side plate 40, 42. The redistribution and transfer of loads is especially important during unevenly distributed tooth loading. Better side-to-side load transfer allows for less steel to be used in the thumb side plates 40, 42, which reduces cost and weight.

The two-piece construction also creates more design flexibility over the flat plate supports to provide the required section strength in the thumb structure support 46. The thumb structure support 46 allows variations in three dimensions (length, height, width and angle θ), where the flat plate only allows for variation of length, height and width. In addition, the connections between the thumb structure support 46 and the side plates 40, 42 and the teeth 44 are improved over the flat plate structures. In flat plates, the side plates and teeth are connected by welding along a single plane that may provide an area of weakness when subjected to lateral loads and other types of loading during use. In the thumb structure support 46 in accordance with the present disclosure, the outer surfaces 92, 102 of the structure support plates 80, 82, respectively, provide two non-parallel planes for attachment of the side plates 40, 42 and the teeth 44. The second ends 56 of the side plates 40, 42 and structure support ends 60 are provided with shapes corresponding to the outer surfaces 92, 102, respectively, so that the ends 56, 60 face and abut the outer surfaces 92, 102 for welding along both the first planar portions 108, 114 and the second planar portions 110, 116.

Figure 5:
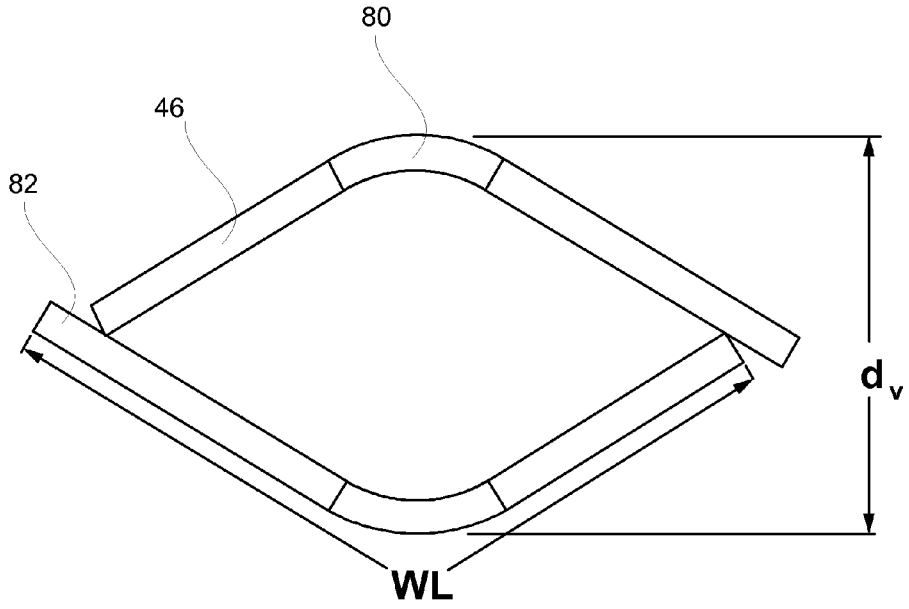
FIG. 5 is a side view of the thumb structure support of the counteracting thumb of FIG. 2.
Figure 6:
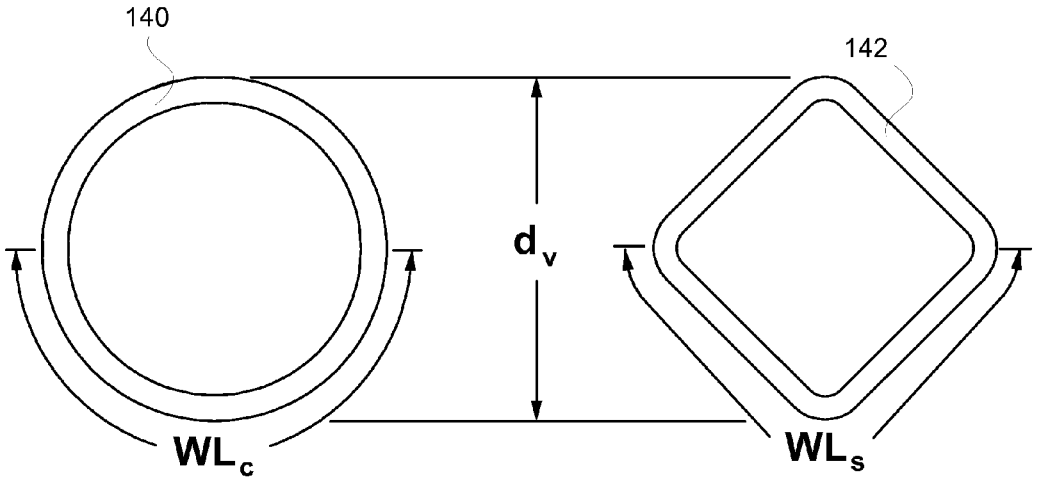
FIG. 6 (Prior Art)
FIG. 6 is a side view of prior art circular tube and square tube supports having comparable vertical distances as the thumb structure support of FIG. 5.

This configuration also provides increased strength against torsion loads over circular tube-type structure supports as shown in the Zeno et al. patent. Instead of bearing predominantly torsion stresses at the points of connection, the connections between the ends 56, 60 and the outer surfaces 92, 102 will also have the torsion loads distributed among compressive and tensile stresses to better allow the thumb 20 to withstand the torsion loads. The use of the circular tube requires a higher dependence on the welds to transfer the load between the circular tube and the side plates 40, 42, which can be problematic. The thumb structure support 46 allows for a larger area of direct force transfer between the teeth 44 and the structure support 46 compared to a circular tube or the square tube. FIGS. 5 and 6 illustrate the disparities in the weld lengths between the thumb structure support 46 (FIG. 5) in accordance with the present disclosure, and a circular tube support 140 (FIG. 6) and a square tube support 142 (FIG. 6).

The supports 46, 140, 142 as illustrated have a common vertical distance $d_v$ when viewed in profile. A vertical distance $d_v$ of the thumb structure support 46 of approximately 120 mm (approximately 4.724 inches) may equate to the circular tube support 140 being formed from a 120 mm (4.724 inches) diameter round tube and the square tube support 142 being formed from an approximately 100 mm (approximately 3.937 inches) square tube. At that vertical distance $d_v$, the thumb structure support 46 of the present design provides a weld length $WL_d$ of approximately 243 mm (approximately 9.567 inches) for attachment of the side plates 40, 42 to the structure support plate 80 and for attachment of the teeth 44 to the structure support plate 82. In contrast, the circular tube support 140 provides a weld length $WL_c$ of approximately 189 mm (approximately 7.441 inches) on each side of the tube, and the square tube support 142 provides a weld length $WL_s$ of approximately 179 mm (approximately 7.047 inches). Consequently, the thumb structure support 46 may provide approximately 28% more weld length than an appropriately sized circular tube support 140, and approximately 35% more weld length than an appropriately sized square tube support 142.

The formed section of the present thumb structure support 46 provides benefits in design and manufacturing over prior square tube structure supports without compromising the benefits of square tubes over flat plates and circular tubes, such as providing welds on two planes between the side plates 40, 42 and teeth 44 and the thumb structure support 46 as discussed above. Despite this benefit in square tube structures, the 90° bends at the corners of the square tubes result in small radii that make creating a good quality robotic weld difficult. The larger radii provided by the obtuse angles $\theta_1$, $\theta_2$ and corresponding gradual weld seam curves allow for the formation of higher quality robotic welds.

Whereas the side plates and teeth may be partially mounted on share sides of the structure support in the square tube design and cause interference with the side plates that may interfere with locating the teeth at optimal positions, the side plates 40, 42 in the present design of the thumb 20 do not interfere with positioning the teeth 44 along the outer surface 102 of the second structure support plate 82. As seen in FIG. 4, the second ends 56 of the side plates 40, 42 do not extend beyond the outer surface 102 of the second structure support plate 82. This configuration allows the teeth 44 to be infinitely positionable along the outer surface 102 of the second structure support plate 82 between the first and second lateral edges 98, 100 of the second structure support plate 82 without obstruction from the side plates 40, 42. As a result, the gusset plate 62 may have any desired configuration of the tines 124 to position the teeth 44 along the outer surface 102.

Figure 7:
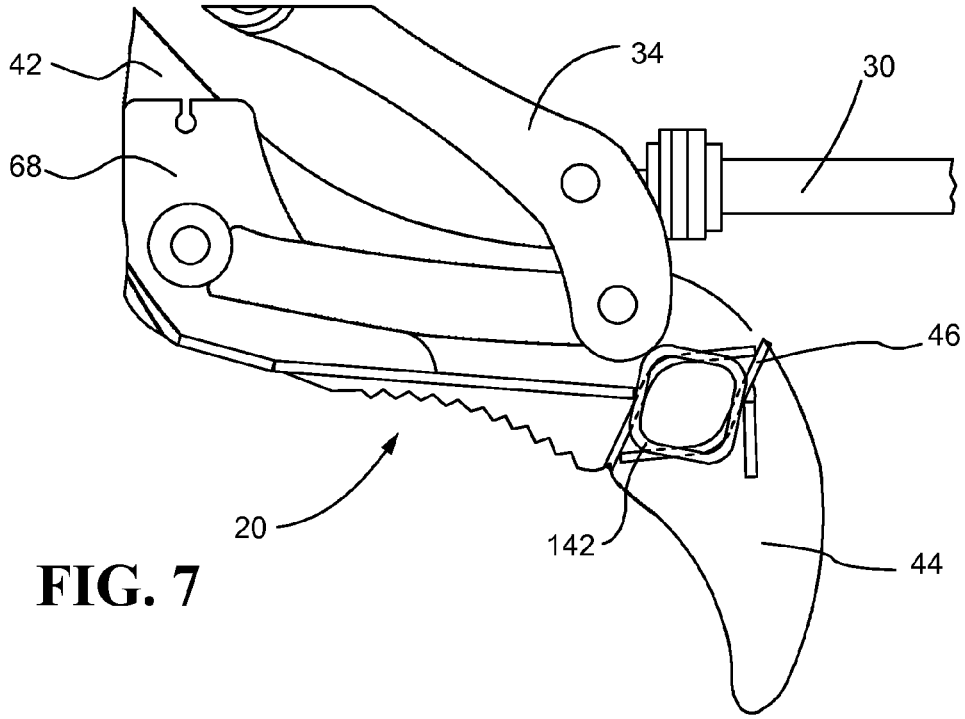
FIG. 7 is a side view of the counteracting thumb and linkage of the thumb of FIG. 1 with the square tube support of FIG. 6 superimposed.

The construction of the thumb structure support 46 facilitates flexibility in designing the thumb structure support 46 with the required section strength to withstand the loads anticipated to be encountered by the thumb 20 and bucket 14. The square tube by definition is limited to having the same length on all four sides, and to have 90° corners. The side lengths and the obtuse angles $\theta_1$, $\theta_2$ can be varied in the thumb structure support 46 as necessary to provide the necessary strength and to fit within a design envelope that will allow the thumb 20 be manipulated properly. FIG. 7 illustrates an embodiment of the thumb 20 with the thumb structure support 46 and the square tube support 142 overlying the thumb structure support 46. The square tube support 142 in this illustration has a greater vertical distance $d_v$ as is necessary since the square tube support 142 having the same vertical distance $d_v$ as the thumb structure support 46 would not provide sufficient strength. Assuming the supports 46, 140 provide comparable strengths to withstand the loading of the thumb 20, the square tube support 140 may encroach into the area between the side plates 40, 42 that may be occupied by the linkage 34. In contrast, the thumb structure support 46 of the present disclosure may have a slimmer profile that provides the linkage 34 with more space between the side plates 40, 42 so that the thumb structure support 46 does not unnecessarily restrict the movement of the thumb 20.

The present design for the thumb structure support 46 may provide additional storage and assembly benefits over the square tube supports. The hollow square tube stock can take up considerable storage space compared to the bent structure support plates 80, 82 from which the thumb structure support 46 is assembled. The structure support plates 80, 82 may be stacked with minimal wasted space versus the empty space taken up by the hollow section within the square tubes. Moreover, in some embodiments, the structure support plates 80, 82 may have generally the same configuration so that the same part may be used for both structure support plates 80, 82. For example, the design may call for the dimensions of the first planar portion 108 of the first structure support plate 80 to be equal to the dimensions of the second planar portion 116 of the second structure support plate 82, the dimensions of the second planar portion 110 of the first structure support plate 80 to be equal to the dimensions of the first planar portion 114 of the second structure support plate 82, and the obtuse angle $\theta_1$ of the first structure support plate 80 to be equal to the obtuse angle $\theta_2$ of the second structure support plate 82. In this design, a single part number may be stored prior to assembly, and two pieces of that part number may be selected and connected as illustrated and described herein to form the thumb structure support 46.

While the preceding text sets forth a detailed description of numerous different embodiments, it should be understood that the legal scope of protection is defined by the words of the claims set forth at the end of this patent. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims defining the scope of protection.

What is claimed is:

1. A thumb for a machine, comprising:

a first side plate having an outer surface, an inner surface oppositely disposed from the outer surface, a first end having a connection for pivotally connecting the first side plate to a linkage assembly of the machine, and a second end oppositely disposed from the first end;

a second side plate having an outer surface, an inner surface oppositely disposed from the outer surface, a first end having a connection for pivotally connecting the first side plate to a linkage assembly of the machine, and a second end oppositely disposed from the first end;

a plurality of teeth each having a work material engaging end and a structure support end oppositely disposed from the work material engaging end; and a thumb structure support, comprising:

a first structure support plate having oppositely disposed first and second end edges, oppositely disposed first and second lateral edges, an outer surface having a convex curvature as the outer surface extends from the first end edge to the second end edge, and an inner surface opposite the outer surface, the second end of the first side plate being connected to the outer surface of the first structure support plate proximate the first lateral edge of the first structure support plate, the second end of the second side plate being connected to the outer surface of the first structure support plate proximate the second lateral edge, and a second structure support plate having oppositely disposed first and second end edges, oppositely disposed first and second lateral edges, an outer surface having a convex curvature as the outer surface extends from the first end edge to the second end edge, and an inner surface opposite the outer surface, the first end edge of the first structure support plate being connected to the second structure support plate proximate the first end edge of the second structure support plate, the second end edge of the second structure support plate being connected to the first structure support plate proximate the second end edge of the first structure support plate, and the structure support end of each of the plurality of teeth being connected to the outer surface of the second structure support plate.

2. The thumb of claim 1, with the outer surface of each of the structure support plates comprising a first planar portion extending inwardly from the first end edge and a second planar portion extending inwardly from the second end edge, the first planar portion and the second planar portion being oriented with respect to each other at an obtuse angle.

3. The thumb of claim 2, with the obtuse angles between the first planar portion and second planar portion of the outer surface of each structure support plate being approximately 120°.

4. The thumb of claim 2, with dimensions of the first planar portion of the outer surface of the first structure support plate being equal to dimensions of the second planar portion of the outer surface of the second structure support plate, dimensions of the second planar portion of the outer surface of the first structure support plate being equal to dimensions of the first planar portion of the outer surface of the second structure support plate, and the obtuse angle of the outer surface of the first structure support plate being equal to the obtuse angle of the outer surface of the second structure support plate.

5. The thumb of claim 2, with the outer surface of each of the structure support plates comprising an intermediate curved portion between the first and second planar portions of the outer surface having a center of a radius of curvature of the intermediate curved portion and orienting the first and second planar portions at the obtuse angle, and with a first line connecting the centers of the radiuses of curvature of the intermediate curved portions being approximately perpendicular to a second line drawn through the points of contact between the first end edge of the first structure support plate and the second structure support plate and the second end edge of the second structure support plate and the first structure support plate.

6. The thumb of claim 1, with the inner surface of each of the structure support plates having a concave curvature as the inner surface extends from the first end edge to the second end edge, and the concave curvature matches the convex curvature of the outer surface so that the structure support plates have a constant thickness.

7. The thumb of claim 1, the first end edge of the first structure support plate being connected to the inner surface of the second structure support plate proximate the first end edge of the second structure support plate, and the second end edge of the second structure support plate being connected to the inner surface of the first structure support plate proximate the second end edge of the first structure support plate.

8. The thumb of claim 1, with the second ends of the side plates not extending beyond the outer surface of the second structure support plate such that the plurality of teeth are infinitely positionable along the outer surface of the second structure support plate between the first lateral edge and the second lateral edge of the second structure support plate without obstruction from the first side plate and the second side plate.

9. The thumb of claim 1, comprising a gusset plate having oppositely disposed first and second end edges and oppositely disposed first and second lateral edges, the first end edge of the gusset plate being connected to the outer surface of the second structure support plate, the second end edge having a plurality of tines extending there from with pairs of tines forming slots there between, the plurality of teeth each having a notch extending inwardly from the structure support end with the plurality of teeth being inserted in the slots between the pairs of tines and the second end edge of the gusset plate being received in the notches of the plurality of teeth.

10. A thumb structure support for connecting first and second side plates of a thumb of a machine to a plurality of teeth of the thumb, comprising:

a first structure support plate having oppositely disposed first and second end edges, oppositely disposed first and second lateral edges, an outer surface having a convex curvature as the outer surface extends from the first end edge to the second end edge, and an inner surface opposite the outer surface, the outer surface of the first structure support plate having the first side plate and the second side plate of the thumb connected thereto proximate the first lateral edge and the second lateral edge, respectively; and a second structure support plate having oppositely disposed first and second end edges, oppositely disposed first and second lateral edges, an outer surface having a convex curvature as the outer surface extends from the first end edge to the second end edge, and an inner surface opposite the outer surface, the first end edge of the first structure support plate being connected to the second structure support plate proximate the first end edge of the second structure support plate, the second end edge of the second structure support plate being connected to the first structure support plate proximate the second end edge of the first structure support plate, and the outer surface of the second structure support plate having the plurality of teeth of the thumb connected thereto.

11. The thumb structure support of claim 10, with the outer surface of each of the structure support plates comprising a first planar portion extending inwardly from the first end edge and a second planar portion extending inwardly from the second end edge, the first planar portion and the second planar portion being oriented with respect to each other at an obtuse angle.

12. The thumb structure support of claim 11, with the obtuse angles between the first planar portion and second planar portion of the outer surface of each structure support plate being approximately 120°.

13. The thumb structure support of claim 11, with dimensions of the first planar portion of the outer surface of the first structure support plate being equal to dimensions of the second planar portion of the outer surface of the second structure support plate, dimensions of the second planar portion of the outer surface of the first structure support plate being equal to dimensions of the first planar portion of the outer surface of the second structure support plate, and the obtuse angle of the outer surface of the first structure support plate being equal to the obtuse angle of the outer surface of the second structure support plate.

14. The thumb structure support of claim 11, with the outer surface of each of the structure support plates comprising an intermediate curved portion between the first and second planar portions of the outer surface having a center of a radius of curvature of the intermediate curved portion and orienting the first and second planar portions at the obtuse angle, and with a first line connecting the centers of the radiuses of curvature of the intermediate curved portions being approximately perpendicular to a second line drawn through the points of contact between the first end edge of the first structure support plate and the second structure support plate and the second end edge of the second structure support plate and the first structure support plate.

15. The thumb structure support of claim 10, the first end edge of the first structure support plate being connected to the inner surface of the second structure support plate proximate the first end edge of the second structure support plate, and the second end edge of the second structure support plate being connected to the inner surface of the first structure support plate proximate the second end edge of the first structure support plate.

16. A thumb for a machine, comprising:

a thumb structure support, comprising:

a first structure support plate having oppositely disposed first and second end edges, oppositely disposed first and second lateral edges, a first planar portion extending inwardly from the first end edge and a second planar portion extending inwardly from the second end edge, the first planar portion and the second planar portion being oriented with respect to each other at an obtuse angle, an outer surface and an inner surface opposite the outer surface, and a second structure support plate having oppositely disposed first and second end edges, oppositely disposed first and second lateral edges, a first planar portion extending inwardly from the first end edge and a second planar portion extending inwardly from the second end edge, the first planar portion and the second planar portion being oriented with respect to each other at an obtuse angle, an outer surface and an inner surface opposite the outer surface, the first end edge of the first structure support plate being connected to the second structure support plate proximate the first end edge of the second structure support plate, and the second end edge of the second structure support plate being connected to the first structure support plate proximate the second end edge of the first structure support plate;

a first side plate having an outer surface, an inner surface oppositely disposed from the outer surface, a first end having a connection for pivotally connecting the first side plate to a linkage assembly of the machine, and a second end oppositely disposed from the first end, the second end of the first side plate having a shape corresponding to a shape of the outer surface of the first structure support plate and being connected to the outer surface of the first structure support plate proximate the first lateral edge of the first structure support plate;

a second side plate having an outer surface, an inner surface oppositely disposed from the outer surface, a first end having a connection for pivotally connecting the first side plate to a linkage assembly of the machine, and a second end oppositely disposed from the first end, the second end of the second side plate having a shape corresponding to a shape of the outer surface of the first structure support plate and being connected to the outer surface of the first structure support plate; and a plurality of teeth each having a work material engaging end and a structure support end oppositely disposed from the work material engaging end, the structure support end having a shape corresponding to a shape of the outer surface of the second structure support plate and being connected to the outer surface of the second structure support plate.

17. The thumb of claim 16, with the obtuse angles between the first planar portion and second planar portion of each structure support plate being approximately 120°.

18. The thumb of claim 16, with dimensions of the first planar portion of the first structure support plate being equal to dimensions of the second planar portion of the second structure support plate, dimensions of the second planar portion of the first structure support plate being equal to dimensions of the first planar portion of the second structure support plate, and the obtuse angle of the first structure support plate being equal to the obtuse angle of the second structure support plate.

19. The thumb of claim 16, with the first end edge of the first structure support plate being connected to the inner surface of the second structure support plate proximate the first end edge of the second structure support plate, and the second end edge of the second structure support plate being connected to the inner surface of the first structure support plate proximate the second end edge of the first structure support plate.

20. The thumb of claim 16, with the second ends of the side plates not extending beyond the outer surface of the second structure support plate such that the plurality of teeth are infinitely positionable along the outer surface of the second structure support plate between the first lateral edge and the second lateral edge of the second structure support plate without obstruction from the first side plate and the second side plate.

* * * * *